US005658196A

United States Patent [19]

Swaim

[11] Patent Number: 5,658,196

[45] Date of Patent: Aug. 19, 1997

[54] INSULATED AIR DIFFUSER

[75] Inventor: Danny L. Swaim, Granbury, Tex.

[73] Assignee: Marjorie L. Trigg, Alvarado, Tex.

[21] Appl. No.: 556,200

[22] Filed: Nov. 9, 1995

[51] Int. Cl.[6] ..... F24F 13/062

[52] U.S. Cl. ..... 454/300; 454/292; 454/312

[58] Field of Search ..... 454/292, 299, 454/300, 310, 312, 330, 331, 332

[56] References Cited

U.S. PATENT DOCUMENTS

| | | | |
|---|---|---|---|
| 2,852,999 | 9/1958 | Lowensohn | 454/312 |
| 2,928,331 | 3/1960 | Averill | 454/300 |
| 3,110,242 | 11/1963 | O'Day | 454/300 |
| 3,866,950 | 2/1975 | Skoch et al. | 285/4 |
| 3,955,483 | 5/1976 | Sunter | 454/332 |
| 3,985,158 | 10/1976 | Felter | 138/179 |
| 4,088,463 | 5/1978 | Smith | 55/480 |
| 4,210,070 | 7/1980 | Tatum et al. . | |
| 4,266,470 | 5/1981 | Schroeder et al. | 454/297 |
| 4,375,183 | 3/1983 | Lynch . | |
| 4,494,449 | 1/1985 | McCabe | 454/300 X |
| 4,858,520 | 8/1989 | Prochnow et al. | 454/292 |
| 5,211,605 | 5/1993 | Shiga et al. | 454/284 |
| 5,297,326 | 3/1994 | Kline | 454/304 X |
| 5,338,256 | 8/1994 | Tonna | 454/300 X |

*Primary Examiner*—Harold Joyce
*Attorney, Agent, or Firm*—Charles D. Gunter, Jr.

[57] ABSTRACT

An air duct diffuser is shown for attachment to a ceiling grid. The diffuser includes a frame which mounts to the ceiling grid and a louvre which mounts to the frame for directing diffused air within an associated air space. A pre-formed, composite housing of insulating material mounts to the frame and has punch-out duct openings of varying sizes provided therein.

7 Claims, 2 Drawing Sheets

INSULATED AIR DIFFUSER

BACKGROUND OF THE INVENTION

1. Field of the Invention

The present invention relates generally to air diffusers for connecting a duct to an airspace for distributing hot or cold air to the airspace and, more specifically, to such a duct in an air conditioning or heating system with improved insulating properties for preventing moisture condensation in a ceiling installation.

2. Description of the Prior Art

In a typical air conditioning and heating installation, the terminal end of the duct system is fixed to a ceiling or wall and is provided with a diffuser assembly through which air streams are diffused indoors. In the case of a suspended ceiling, the ceiling structure is typically made up of an interlocking grid of struts or tees, suspended from the concrete slab of the roof or the floor of the next storey of the building and having panels of acoustic or similar materials supported on the struts.

To permit communication between the duct work for any air conditioning and heating system and the area located beneath the suspended system, lay-in diffusers are often provided which are capable of resting upon and extending between the array of struts and tees used to support the ceiling panels in position. These diffusers usually have finished bottom portions provided with appropriate louvres or ventilating structures and duct drops are generally provided to connect the duct work with those lay-in diffusers which are being used to ventilate the associated area. Various types of connectors have been provided for connecting the duct with the diffuser, but one problem with such prior connectors was that it was necessary to have a connector of the same size as the air distribution duct, which necessitated providing a separate connector for each size of duct. This meant that several sizes of connectors were required to be stocked, one for each size duct. Often, an installer would not have the right size connector, or connectors, on the job which necessitated a return trip to the shop, or supplier.

Depending upon the desired flow distribution pattern, the air diffuser assembly may assume various forms including planar vane grading, linear slots, pan forms, and the like. The diffuser elements were typically formed of steel, aluminum or other sheet material of a desired shape and were often baked and coated with melamine, or other finish. One commonly seen diffuser is provided with annular diffuser elements of a conical shape in section and spaced at given intervals, the elements being molded of aluminum sheet and coated on their surfaces. Other vane grading type diffusers are well known with the diffuser elements being provided by integral molding of aluminum or other types of sheet material.

The prior art diffuser elements, molded of such metal materials as steel and aluminum sheet, are likely to accumulate indoor moisture on their surfaces and be cooled, resulting in dew condensation. This effect causes the diffusers to become stained or allows dew drops to trickle down into the interior space. As a result, it was usually necessary to apply cut or roll insulation to the outside of the box and associated duct and/or duct connector after it was installed. Cutting and fastening of the insulation to the diffuser is tedious and time consuming and therefore expensive.

A need exists for an improved air duct diffuser for attachment to a ceiling which is provided with a prefromed, insulated backing which does not require a separate wrapping or backing step once the diffuser is installed in place within the ceiling grid.

A need also exists for an improved diffuser which is simple in design and economical to manufacture which has improved thermal properties to lessen or prevent condensation within the diffuser assembly.

A need also exists for a diffuser having an improved means for connection to a variety of different sized air ducts.

A need also exists for such a diffuser having an improved means for suspending a diffuser element or louvre within an associated frame.

SUMMARY OF THE INVENTION

The air duct diffuser of the invention includes a frame which mounts to a support structure of the ceiling. A louvre mounts to the frame for diffusingly directing air from the air duct located within the ceiling. A pre-formed, composite housing of insulating material mounts to the frame, the housing having a duct opening provided therein to closely receive the air duct.

Preferably, the air duct diffuser includes a metal frame which mounts to the support structure of the ceiling with the louvre being mounted within the metal frame. The pre-formed, composite housing is preferably comprised of a fiberglass duct board having an inner side which receives the metal frame and an outer side, the outer side being covered with a metal foil vapor barrier. The duct board can be provided with a plurality of concentric score lines formed therein which define weakened, punch-out areas, each are being sized to receive a selected one of a plurality of common sized air ducts. The louvre can be mounted on a pair of spacer bars within the metal frame, at least one of the spacer bars having a release mechanism which allows the louvre to pivot downwardly within the frame to allow access to the interior of the frame.

The air duct diffuser is preferably assembled by providing a frame which is mountable within the existing support structure of the ceiling, the frame having an inner side and an outer side. The frame is backed with the pre-formed, composite housing of insulating material and the louvre is mounted within the frame by suspending the louvre from at least two spacer bars located within the frame. The frame is backed with the pre-formed, composite housing by providing a lip on the housing which is sized to receive a mating lip on the frame and by applying an adhesive between the mating lips, whereby the frame and housing can be assembled without screws or fasteners. The pre-formed, composite housing can be formed in any convenient manner such as by stamping out the housing in a press mold of the desired shape.

Additional objects, features and advantages will be apparent in the written description which follows.

DETAILED DESCRIPTION OF THE INVENTION

Figure 1:
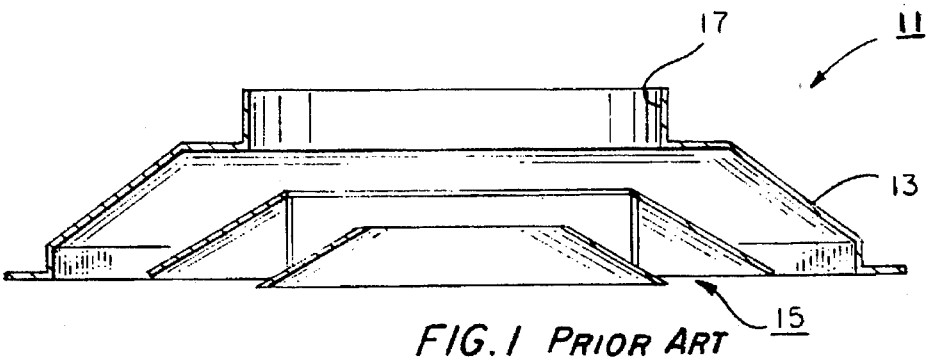
FIG. 1 PRIOR ART
FIG. 1 shows a prior art square ceiling diffuser of all steel construction.

Turning first to FIG. 1, there is shown a prior art air diffuser, designated generally as 11. The diffuser 11 is of all steel or aluminum construction and includes a steel frame 13 from which is suspended a louvre assembly 15 and which includes a fixed duct connector opening 17 of a given size such as, four inch, six inch, eight inch, ten inch, etc. As has been discussed, the prior art diffuser 11 necessitated that the appropriate size duct opening 17 be provided for connection to the air duct, or that a connector or an adapter of some sort be utilized. The all metal design of the prior art was also problematical in that dew or moisture tended to collect within the diffuser assembly, causing staining or discoloration and allowing moisture droplets to fall from the diffuser within the interior of the space being provided with diffused air.

Figure 2:
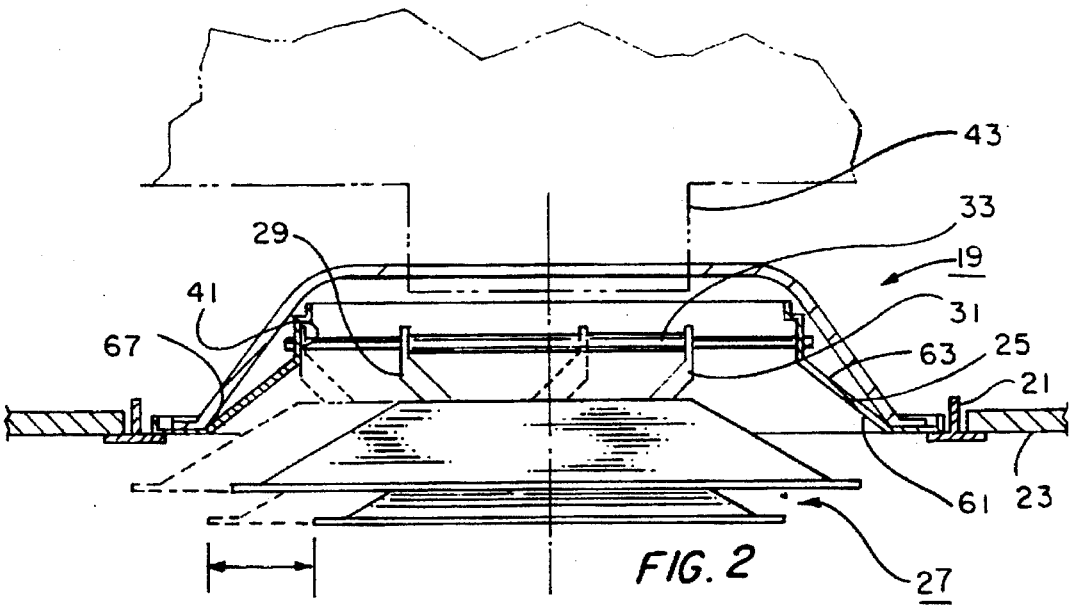
FIG. 2 is a vertical cross-section view taken along line II—II of FIG. 3, partly broken away, of the air diffuser of the invention showing the allowable side-to-side movement of the louvre within the metal frame.

FIG. 2 shows the air duct diffuser of the invention designated generally as 19. The diffuser is adapted to be mounted within a ceiling which includes support struts or tees 21 and associated ceiling tile members 23. The ceiling grid structure is also illustrated in more detail in FIG. 6.

While suspended ceilings of the type illustrated herein are primarily in multi-storey public and commercial buildings, the invention is also applicable to any type of building or ceiling structure where services are provided in the space or void between the ceiling and the concrete slab, roof or other structure disposed above the ceiling. Such ceilings typically incorporate various fixtures such as lighting, troffers, air handling diffusers and grilles, electrical wiring, plumbing, and the like.

Figure 6:
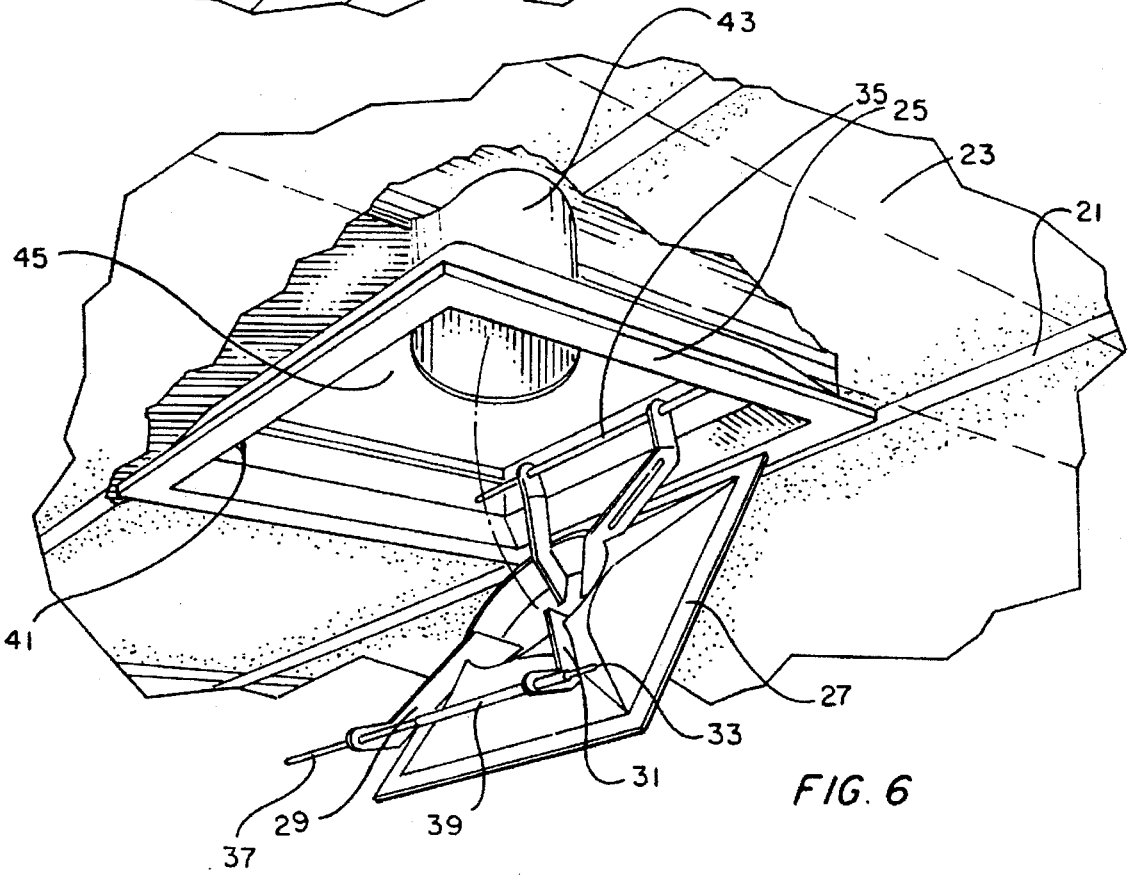
FIG. 6 is a perspective view of the air diffuser of the invention installed within a ceiling grid showing the downward pivotal movement of the louvre on the spacer bar.

The air diffuser of the invention includes a rigid frame 25 which can be of metal and which is typically stamped or extruded in a desired shape such as the square shape shown in FIG. 6. A louvre assembly containing one or more louvres, designated as 27, is suspended within the frame 25 by means of pairs of support legs (29, 31, shown in FIG. 2) and an associated spacer bar 33, 35. As shown in FIG. 2, the louvre assembly 27 can move a short distance in side-to-side fashion to allow adjustment of the position of the louvre assembly 27 on the support legs 29, 31. As shown in FIG. 6, the spacer bar 33 includes an inner rod 37 mounted within an outer cylindrical tube 39 which carries an inner spring, whereby the ends of the bar are spring loaded allowing the bar to be received between mating openings 41 provided within the metal housing. As shown in FIG. 6, compressing the inner rod 37 within the spring loaded tube 39 shortens the overall spacer bar length, allowing the louvre 27 to pivot downwardly within the frame to allow access to the interior of the diffuser or air duct.

Figure 3:
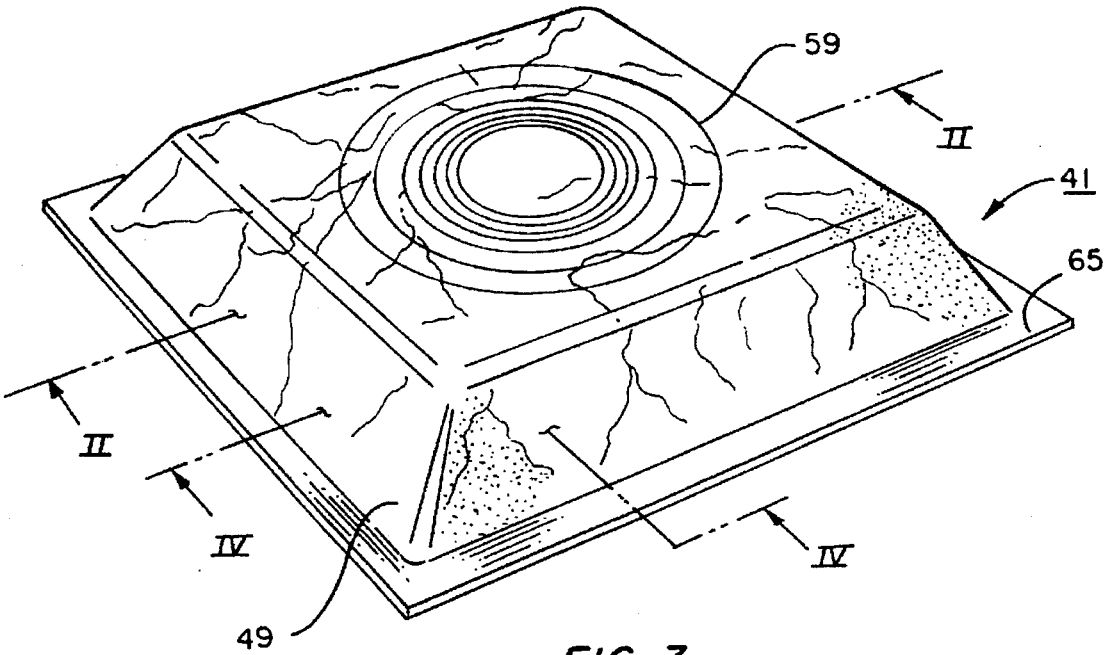
FIG. 3 is a top, perspective view of the pre-formed, composite housing of insulating material which is used to back the metal frame of the diffuser of the invention and showing the score lines formed therein.

A pre-formed, composite housing of insulating material (41 in FIG. 3) is provided for mounting to the frame and has a duct opening provided therein for closely receiving an associated air duct (43 in FIGS. 2 and 6). The pre-formed, composite housing can be provided of any convenient insulating material which can be pre-formed in a rigid shape. Preferably, the insulating material is a fiberglass duct board such as the Type 475 "Micro-Aire C" duct board commercially available from Manville Air Handling Systems of Denver, Colo. The Type 475 duct board is made from strong, flame attenuated glass fibers which are bonded with a thermosetting resin.

Figure 4:
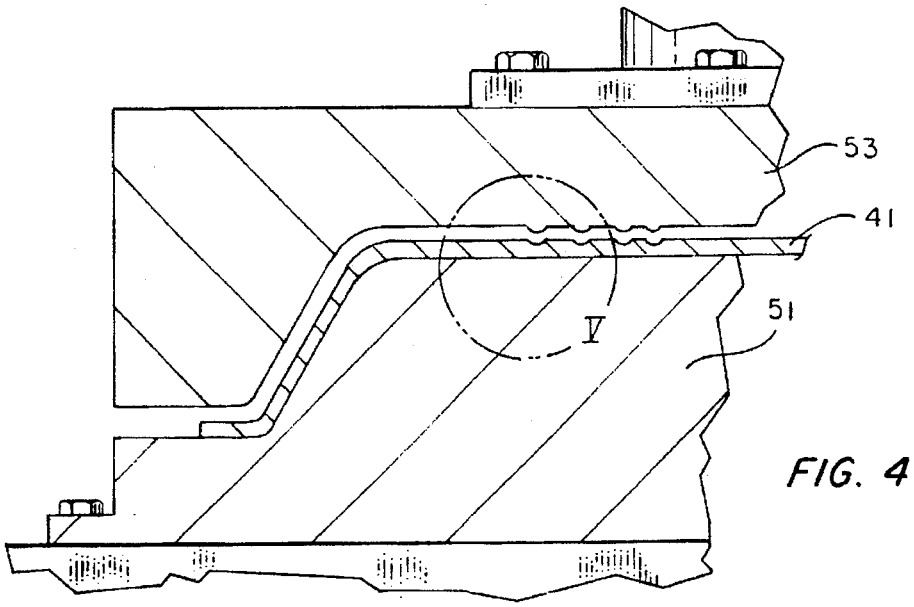
FIG. 4 is a simplified vertical cross-section view taken along line IV—IV of FIG. 3, partially in section, of a press mold used to pre-form the composite housing of insulating material shown in FIG. 3.
Figure 5:
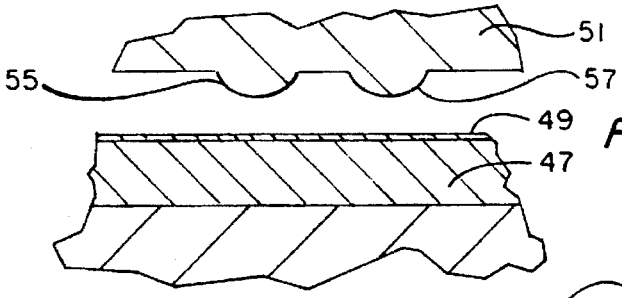
FIG. 5 is an isolated, close-up view of that portion of the mold of FIG. 4 taken along line V therein.

The duct board insulating material is pre-formed in a shape which is complementary to the metal frame 25 for receiving the metal frame and forming a backing thereof. The duct board has an inner side 45 which receives the metal frame and an outer side 47 which is preferably covered with a metal foil vapor barrier 49. The metal foil backing layer 49 can be an aluminum foil or other insulating foil which provides a vapor barrier and prevents thermal loss. For example, a suitable "HDF" foil is available from Manville Air Handling Systems and consists of foil, fiberglass scrim reinforcement and one or more layers of craft paper, laminated in a foil-scrim paper pattern. FIG. 4 shows a typical mold which includes lower platen 51 and upper platen 53 which are used to form the composite housing 41. The composite material is formed under heat and pressure in a desired shape such as the generally square shape shown in FIG. 3. As shown in FIG. 4 and in close-up fashion in FIG. 5, the upper mold platen 51 can be provided with protrusions 55, 57 which are used to form a plurality of concentric score lines (59 in FIG. 3) which define weakened, punch-out areas, each area being sized to receive a selected one of a plurality of common sized air ducts. Thus, the concentric rings 59, shown in FIG. 3, can be provided with, for example, four inch, six inch, eight inch, etc. diameters.

The air duct diffuser of the invention can be assembled by providing a frame 25 which is appropriately sized to be mountable within an existing support structure 21 of a ceiling grid, the frame having an interior 61 and an exterior 63. The frame is backed with the previously described pre-formed, composite housing of insulating material 41 which has a plurality of concentric score lines 59 formed therein which defined weakened, punch-out areas. A rigid louvre assembly 27 is mounted on a pair of spacer bars 33, 35 within the rigid frame. Preferably, at least one of the spacer bars is spring loaded to pivotally release the louvre for access to the frame interior.

The frame is backed with the pre-formed, composite housing 41 by providing a lip on the housing (65 in FIG. 3) which is sized to receive a mating lip 67 on the frame 25 (see FIG. 2). Preferably, an adhesive or other sealant is applied between the mating lips 65, 67, whereby the frame and housing can be assembled without screws or other mechanical fasteners. The frame lip 67 can be appropriately oversized to allow the lip to be crimped or folded back upon the housing lip 65 to further secure the backing to the frame.

An invention has been provided with several advantages. The air diffuser of the invention can be quickly and easily installed in lay-in fashion within any of a number of commonly available locations, such as ceiling grid systems. The air diffuser can be pre-assembled with a composite backing which serves as a thermal insulator and vapor barrier to prevent staining of the louvre element or condensation from forming and falling from the unit. The composite backing can be conveniently pre-formed in a press of fiberglass duct board with a metal foil backing and can have pre-formed weakened punch-out regions which are selectively sized to receive a variety of air ducts for connecting a selected duct to the assembly. The rigid louvre can be mounted on a spacer bar in quick release fashion within the metal frame, whereby the louvre can be pivoted downwardly within the frame for ease of access during maintenance or installation. The diffuser assembly is pleasing in appearance and blends with the existing ceiling grid to provide a uniform appearance. It is not necessary for the installer to handwrap the diffuser or duct connector with insulating tape or other insulating materials. The pre-formed punch-out areas in the composite housing eliminate the need for stocking duct connectors of various sizes.

While the invention has been shown in only one of its forms, it is not thus limited but is susceptible to various changes and modifications without departing from the spirit thereof.

What is claimed is:

1. An air duct diffuser for attachment to a ceiling which can be used for diffusing air from an air duct located in the ceiling, the air duct diffuser comprising:

a metal frame which mounts to a support structure of the ceiling;

a louvre which mounts to the metal frame for diffusingly directing air from the air duct;

a preformed, composite housing of insulating material which mounts to the metal frame, the housing having a duct opening provided therein to closely receive the air duct;

wherein the performed, composite housing is comprised of fiberglass duct board;

wherein the fiberglass duct board is preformed in a shape which is complimentary to the metal frame for receiving the metal frame and forming a backing therefor; and wherein the fiberglass duct board has an inner side which receives the metal frame and an outer side, the outer side being covered with a metal foil vapor barrier.

2. An air duct diffuser for attachment to a ceiling which can be used for diffusing air from air ducts of different sizes located in the ceiling, the air duct diffuser comprising:

a metal frame which mounts to a support structure of the ceiling;

a louvre which mounts to the metal frame for diffusingly directing air from the air duct;

a preformed, composite housing of fiberglass duct board which mounts to the metal frame, the fiberglass duct board being preformed in a shape which is complimentary to the metal frame with an inner side for receiving the metal frame and forming a backing therefor and with an outer side, the outer side being covered with a metal foil vapor barrier, the duct board of the preformed, composite housing having a plurality of concentric score lines formed therein which define weakened, punch-out areas, each area being sized to receive a selected one of a plurality of common sized air ducts whereby a selected air duct can be connected to the frame for directing air to the louvre for diffusing air from the louvre into a space located below the louvre;

wherein the louvre is mounted on a pair of spacer bars within the metal frame, at least one of the spacer bars having a release mechanism which allows the louvre to pivot downwardly within the frame to allow access to the interior of the frame.

3. A method of assembling an air duct diffuser of the type which is connected to an air duct of a ceiling, the method comprising the steps of:

providing a frame which is mountable within an existing support structure of the ceiling, the frame having an inner side and an outer side;

backing the frame with a preformed, composite housing of insulating material, the housing having a plurality of concentric score lines formed therein which define weakened, punch-out areas, each area being sized to receive a selected one of a plurality of common sized air ducts for mounting a selected duct to the housing and, in turn, to the frame;

mounting a louvre to the frame by suspending the louvre from at least two spacer bars located within the frame; and wherein the composite housing is comprised of fiberglass duct board which is preformed in a shape which is complimentary to the metal frame for receiving the metal frame and forming a backing therefor, the fiberglass duct board having an inner side which receives the metal frame and an outer side, the outer side being covered with a metal foil vapor barrier.

4. The method of claim 3, further comprising the steps of:

backing the frame with the preformed composite housing by providing a lip on the housing which is sized to receive a mating lip on the frame and applying an adhesive between the mating lips, whereby the frame and housing can be assembled without screws or fasteners.

5. The method of claim 4, further comprising the steps of:

spring loading at least one of the spacer bars used to mount the louvre within the frame, whereby releasing the spring loaded bar allows the louvre to pivot within the frame to allow access to the frame interior and the duct.

6. The method of claim 5, wherein the preformed, composite housing is stamped out in a press mold in the desired shape.

7. The method of claim 6, wherein the frame is formed of metal by extruding the metal in a desired shape.

* * * * *